US007935885B2

(12) United States Patent
Elie et al.

(10) Patent No.: US 7,935,885 B2
(45) Date of Patent: May 3, 2011

(54) INSULATED ASSEMBLY OF INSULATED ELECTRIC CONDUCTORS

(75) Inventors: Larry Dean Elie, Ypsilanti, MI (US); Allan Roy Gale, Livonia, MI (US); John Matthew Ginder, Plymouth, MI (US); Clay Wesley Maranville, Ypsilanti, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 362 days.

(21) Appl. No.: 12/171,525

(22) Filed: Jul. 11, 2008

(65) Prior Publication Data

US 2010/0006318 A1 Jan. 14, 2010

(51) Int. Cl.
*H01B 7/00* (2006.01)

(52) U.S. Cl. ..... 174/36; 174/110 R

(58) Field of Classification Search ..... 174/126.1, 174/126.2, 126.4, 128.1, 128.2, 129 R
See application file for complete search history.

(56) References Cited

U.S. PATENT DOCUMENTS

| | | | | |
|---|---|---|---|---|
| 723,717 | A * | 3/1903 | Nicholson et al. | 428/652 |
| 2,700,212 | A * | 1/1955 | Flynn et al. | 428/623 |
| 4,390,586 | A | 6/1983 | Lemelson | |
| 5,057,651 | A | 10/1991 | Hope et al. | |
| 5,091,609 | A | 2/1992 | Sawada et al. | |
| 5,209,987 | A | 5/1993 | Penneck et al. | |
| 5,300,733 | A | 4/1994 | Uematsu | |
| 5,336,851 | A * | 8/1994 | Sawada et al. | 174/110 A |
| 5,372,886 | A * | 12/1994 | Inazawa et al. | 428/384 |
| 5,625,332 | A | 4/1997 | Kamo et al. | |
| 6,229,093 | B1 | 5/2001 | Haefele | |
| 6,261,437 | B1 | 7/2001 | Hernnaes et al. | |
| 6,864,613 | B1 | 3/2005 | Graham et al. | |
| 6,951,985 | B1 | 10/2005 | Lemelson | |
| 7,572,980 | B2 * | 8/2009 | Elie et al. | 174/110 A |
| 2002/0053461 | A1 * | 5/2002 | Leijon et al. | 174/128.1 |
| 2005/0066516 | A1 | 3/2005 | Graham et al. | |

FOREIGN PATENT DOCUMENTS

| | | |
|---|---|---|
| EP | 0410003 A1 | 1/1991 |
| EP | 0729157 A1 | 8/1996 |
| EP | 0813243 A2 | 12/1997 |
| JP | 2129809 | 5/1990 |
| JP | 3077207 | 4/1991 |

* cited by examiner

*Primary Examiner* — William H Mayo, III
(74) *Attorney, Agent, or Firm* — Frank A. MacKenzie; Brooks Kushman P.C.

(57) ABSTRACT

An insulated assembly of insulated electric conductors includes a first plurality of insulated electric conductors. Each insulated electric conductor has a copper core, a uniform thickness thin sheet of aluminum that is mechanically formed to envelope the copper core and a single dielectric layer of aluminum oxide that is formed by anodizing an outer surface of the thin sheet of aluminum. A first aluminum layer is mechanically formed to envelope the first plurality of insulated electric conductors and a first single dielectric layer of aluminum oxide surrounds the first aluminum layer.

20 Claims, 7 Drawing Sheets

INSULATED ASSEMBLY OF INSULATED ELECTRIC CONDUCTORS

BACKGROUND OF THE INVENTION

1. Field of the Invention

The present disclosure relates to an insulated assembly of insulated electric conductors wherein each conductor is individually insulated in an anodized aluminum dielectric layer, bundled together in various configurations, and then the bundled configurations are insulated in an anodized aluminum dielectric layer.

2. Background Art

In U.S. Pat. No. 7,572,980, a single stranded copper conductor with an anodized aluminum dielectric layer was disclosed. That application described an insulated electric conductor for carrying signals or current having a copper core of various geometries with a single thermally conductive dielectric layer of anodized aluminum (aluminum oxide). That application is incorporated herein by reference.

Conventional wire assemblies having polymeric insulation around copper wires can typically tolerate ohmic (or other) heating of up to approximately 250° C. Once a copper wire heats to temperatures beyond 250° C., the polymeric insulation can break down or melt, thus resulting in short circuits and related failures. Additionally, polymeric insulation is limited in its capacity to tolerate environmental hazards such as exposure to salt spray and other environmental conditions as are typically encountered by insulation employed in automotive applications.

While the single copper conductor described in U.S. Pat. No. 7,572,980 would be capable of tolerating heating (ohmic and otherwise) in excess of 250° C. and while the aluminum oxide coating could withstand environmental conditions encountered in typical automotive applications such as salt spray, employing single strands of the copper conductor described in U.S. Pat. No. 7,572,980 may require the attachment and positioning of hundreds or thousands of individual conductors on and throughout a typical automobile. It is desirable to have bundles of insulated copper wires having high heat tolerances that are resilient to environmental conditions and that have a high packing density permitted by thin insulation thicknesses. The embodiments of the invention described below address these and other problems.

SUMMARY OF THE INVENTION

In a first aspect of the invention, an insulated assembly of insulated electric conductors is disclosed. In a first embodiment, the assembly comprises a first plurality of insulated electric conductors. Each individual electric conductor has a copper core, a uniform thickness thin sheet of aluminum that is mechanically formed to envelope the copper core. Each individual electric conductor also has a single dielectric layer of aluminum oxide that is formed by anodizing the outer surface of a thin sheet of aluminum. The assembly further comprises a first aluminum layer that is mechanically formed to envelope the first plurality of insulated electric conductors. The assembly further comprises a first single dielectric layer of aluminum oxide that surrounds the first aluminum layer.

In an implementation of the first embodiment, the insulated assembly further comprises an additional one of the insulated electric conductors that is disposed proximate the first single dielectric layer of aluminum oxide. The insulated assembly further comprises a second aluminum layer that is mechanically formed to envelope the additional one of the insulated electric conductors and the first single dielectric layer of aluminum oxide. The insulated assembly further comprises a second single dielectric layer of aluminum oxide surrounding the second aluminum layer.

In another implementation, the insulated assembly further comprises a second plurality of the insulated electric conductors disposed proximate the first single dielectric layer of aluminum oxide. The insulated assembly also comprises a second aluminum layer that is mechanically formed to envelope the second plurality of the insulated electric conductors and the first single dielectric layer of aluminum oxide. The insulated assembly also comprises a second single dielectric layer of aluminum oxide surrounding the second aluminum layer. In a variation of this implementation, each of the insulated electric conductors of the second plurality may be disposed co-axially about the first single dielectric layer of aluminum oxide. Further, the second aluminum layer and the second single dielectric layer of aluminum oxide may be coaxial with the first single dielectric layer of aluminum oxide.

In another implementation, one of the copper cores comprises a generally circular cross section along substantially an entire longitudinal length of the copper core.

In another implementation, each of the copper cores comprises a generally circular cross section along substantially an entire longitudinal length of the copper core.

In another implementation of the first embodiment, one of the copper cores comprises a generally rectilinear cross section along substantially an entire longitudinal length of the copper core.

In another implementation of the first embodiment, each of the copper cores comprises a generally rectilinear cross section along substantially an entire longitudinal length of the copper core.

In another implementation, the insulated assembly further comprises a second plurality of the insulated electric conductors. The insulated assembly also comprises a second aluminum layer that is mechanically formed to envelope the second plurality of insulated electric conductors. The insulated assembly also comprises a second single dielectric layer of aluminum oxide surrounding the second aluminum layer. The insulated assembly further comprises a third aluminum layer that is mechanically formed to envelope the first single dielectric layer of aluminum oxide and the second dielectric layer of aluminum oxide. The insulated assembly also comprises a third single dielectric layer of aluminum oxide surrounding the third aluminum layer. In a variation of this implementation, each of the copper cores may comprise a generally circular cross section along substantially an entire longitudinal length of the copper core. In an alternate variation, each of the copper cores may comprise a generally rectilinear cross section along substantially a longitudinal length of the copper core. In a further variation, each insulated conductor of the first plurality of insulated conductors may be stacked one on top of the other and each insulated conductor of the second plurality of insulated conductors may be stacked one on top of the other. In some variations, the first plurality of insulated conductors and the second plurality of insulated conductors may be positioned side by side.

In a second embodiment of the first aspect of the invention, the assembly comprises a first plurality of insulated electric conductors. Each electric conductor has a copper core, a uniform thickness thin sheet of aluminum that is mechanically formed to envelope the copper core and a single dielectric layer of aluminum oxide that is formed by anodizing an outer surface of the thin sheet of aluminum. The insulated assembly may further comprise a first single dielectric layer of aluminum oxide that envelopes the plurality of insulated electric conductors. The first single dielectric layer is formed by completing anodizing a first uniform thickness thin sheet of aluminum that has been mechanically formed to envelope the plurality of insulated electric conductors.

In an implementation of the second embodiment, the insulated assembly further comprises an additional one of the insulated electric conductors disposed proximate the first single dielectric layer of aluminum oxide. The insulated assembly further comprises a second single dielectric layer of aluminum oxide that envelopes the additional one insulated electric conductor and the first single dielectric layer. The second dielectric layer may be formed by completely anodizing a second uniform thickness thin sheet of aluminum that has been mechanically formed to envelope the additional one insulated electric conductor and the first single dielectric layer.

In another implementation, the insulated assembly may further comprise a second plurality of the insulated electric conductors disposed proximate the first single dielectric layer of aluminum oxide. A second single dielectric layer of aluminum oxide may envelope the second plurality of the insulated electric conductors and the first single dielectric layer of aluminum oxide. The second single dielectric layer may be formed by completely anodizing a second uniform thickness thin sheet of aluminum that has been mechanically formed to envelope the second plurality of the insulated electric conductors and the first single dielectric layer. In a variation of this implementation, each of the insulated electric conductors of the second plurality may be disposed co-axially about the first single dielectric layer of aluminum oxide. Further, the second single dielectric layer of aluminum oxide is co-axial with the first single dielectric layer of aluminum oxide.

In another implementation of the second embodiment, the insulated assembly may further comprise a second plurality of the insulated electric conductors. The insulated assembly also includes a second single dielectric layer of aluminum oxide enveloping the second plurality of the insulated electric conductors. The second single dielectric layer may be formed by completely anodizing a second uniform thickness thin sheet of aluminum that has been mechanically formed to envelope the second plurality of the insulated electric conductors. The insulated assembly may further comprise a third single dielectric layer of aluminum oxide surrounding the first single dielectric layer of aluminum oxide and the second single dielectric layer of aluminum oxide. The third single dielectric layer may be formed by completing anodizing a third uniform thickness thin sheet of aluminum that has been mechanically formed to envelope the first single dielectric layer of aluminum oxide and the second single dielectric layer of aluminum oxide.

In another implementation of the second embodiment, each of the copper cores may comprise a generally rectilinear cross section along substantially an entire longitudinal length of the copper core.

In another aspect of the invention, a method of making an insulated assembly of insulated electric conductors is disclosed. In the first embodiment of the second aspect, the method includes providing a plurality of copper cores and enveloping each copper core with a uniform thickness thin sheet of aluminum. The method further comprises anodizing an outer surface of each thin sheet of aluminum to form a single dielectric layer of aluminum oxide to electrically insulate each copper core, thus forming a plurality of insulated electric conductors. The plurality of insulated electric conductors is enveloped in an aluminum layer comprising a uniform thickness thin sheet of aluminum and an outer surface of the aluminum layer is anodized to form a single dielectric layer of aluminum oxide to electrically insulate the plurality of insulated electric conductors.

BRIEF DESCRIPTION OF THE DRAWINGS

The description herein makes reference to the accompanying drawing wherein like reference numerals refer to like parts through the several views, and in which.

DETAILED DESCRIPTION OF THE PREFERRED EMBODIMENT(S)

Figure 1:
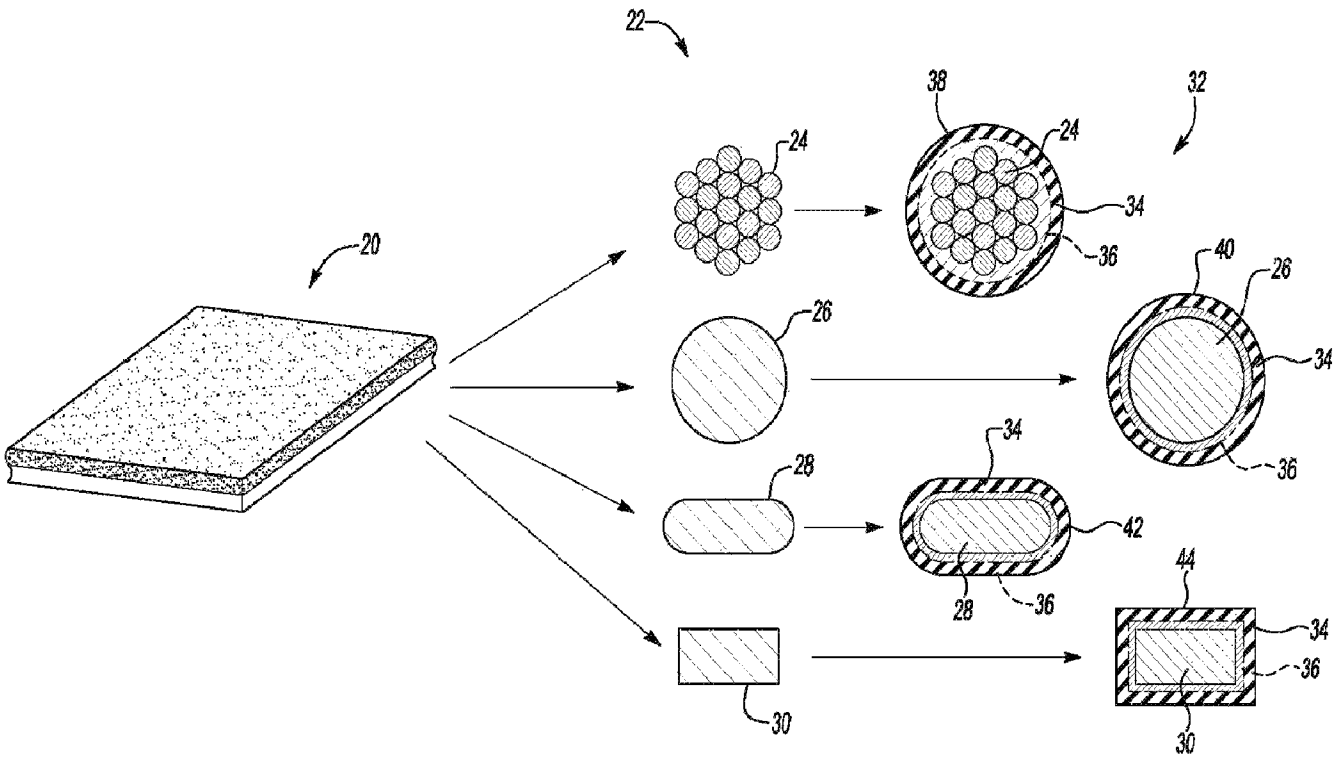
FIG. 1 is graphical representation of a process for forming an insulated electric conductor and various resulting insulated electric conductors having copper or copper alloy cores of various geometries enveloped by an aluminum sheet that is anodized to form a dielectric layer of aluminum oxide.

Detailed embodiments of the present invention are disclosed herein; however, it is to be understood that the disclosed embodiments are merely exemplary of the invention that may be embodied in various and alternative forms. The figures are not necessarily drawn to scale, some features may be exaggerated or minimized to show details of particular components. Therefore, specific structural and functional details disclosed herein are not to be interpreted as limiting, but merely as a representative basis for the claims and/or as a representative basis for teaching one skilled in the art to variously employ the present invention.

The present disclosure includes embodiments having various advantages. For example, embodiments of the present disclosure provide an insulated assembly of insulated electric conductors that is mechanically tough, chemically resistant, and suitable for operation at extreme operating and/or environmental temperatures hundreds of degrees higher than wire assemblies conventionally insulated with polymeric insulation. The single dielectric/insulating layer is robust against strain-related defects during mechanical forming and is economically viable to produce in large quantities and long continuous lengths. The mechanical toughness facilitates forming conductors of various cross-sectional geometries and gage-diameters.

The insulated assemblies of insulated electric conductors disclosed herein have desirable thermal conductivity to dissipate heat and to tolerate higher ohmic heating while resisting electrical and environmental degradation. Additionally, the single dielectric layer of aluminum oxide is resistant to external heating by many hundreds of degrees Celsius beyond conventional wire assemblies insulated with polymeric insulation.

Insulated assemblies disclosed herein are suitable for use, without limitation, in automotive applications and may be routed near or mounted on portions of automobiles such as exhaust systems and engine components having high heat output without substantial degradation in the insulated assemblies' conductivity. The single dielectric layer of aluminum oxide also advantageously provides a layer that is substantially impervious to salt spray and other environmental conditions that the undercarriage of a vehicle is exposed to during operating conditions.

Use of a uniform thickness thin sheet of aluminum with proper control of the anodizing process results in the formation of a single dielectric layer with a substantially smooth outer surface without holes or voids that can be mechanically formed to a plurality of similarly insulated electric conductors. Use of a thin, uniform thickness sheet of aluminum allows for close or dense packing of insulated electric conductors within an insulated assembly and also permits closer dense packing of multiple insulated assemblies thus affording a manufacturer compact packing options when routing insulated assemblies along an undercarriage of a vehicle or throughout various compartments within the vehicle.

With respect to FIG. 1, a representative process/product is illustrated depicting the manufacture of insulated electric conductors for use in an insulated assembly of the present invention. A uniform thickness thin sheet of aluminum 20 is formed to envelope a copper or copper alloy core 22. In FIG. 1, reference numeral 22 refers generally to a plurality of differently configured copper/copper alloy cores including a multiple stranded copper/copper alloy core 24, a generally circular copper/copper alloy core 26, an oval or ribbon-shaped copper/copper alloy core 28 and a rectilinear shaped copper/copper alloy core 30. These illustrated geometries are representative and not intended to be limiting. Copper cores having other geometric configurations may also be employed.

Uniform thickness thin sheet of aluminum 20 may have uniform thicknesses of between about 0.003 inches (76.2 microns) to 0.015 inches (381 microns) with a uniformity of plus or minus 0.005 inches (12.7 microns). Other dimensions may be suitable for particular applications consistent with the teachings of the present disclosure. However, the thickness must be selected consistent with the process for forming the aluminum to the core, anodizing the aluminum to form a dielectric layer, and subsequent forming of the insulated electric conductor to avoid failures that may include subsequent separation, flaking, pitting, etc. of the dielectric layer.

A mechanical cold-forming technique may be used to form aluminum sheet 20 about copper/copper alloy core 22. Other techniques or processes used to form aluminum sheet 20 to copper/copper alloy core 22 may include vacuum welding, radio frequency bonding, high pressure pressing and galling. A particular forming technique may vary depending upon a number of factors that may include the thickness of aluminum sheet 20, the geometry of copper/copper alloy core 22 and/or the particular ultimate application of the insulated electric conductor and the selected implementation of the anodizing process. In some embodiments, aluminum sheet 20 may be anodized prior to enveloping copper/copper alloy core 22. In other embodiments, aluminum sheet 20 is formed to copper/copper alloy core 22 prior to the anodization process.

Insulated electric conductors, represented generally by reference numeral 32 are made by forming sheet of aluminum 20 to envelope a selected copper or copper alloy core 22 with uniform thickness thin sheet of aluminum 20 and partially anodizing an outer surface of uniform thickness thin sheet of aluminum 20 to form a dielectric layer 34 of aluminum oxide that electrically insulates copper/copper alloy core 22, but is thermally conductive to dissipate heat. A thin layer 36 of electrically conductive aluminum surrounds copper/copper alloy core 22 and facilitates adhesion or bonding of dielectric layer 34 to core 22. Insulated electric conductor 38 is formed by enveloping stranded copper/copper alloy core 22 with uniform thickness thin sheet of aluminum 20 and partially anodizing an outer surface of aluminum sheet 20 to form a dielectric layer 34 of aluminum oxide. A similar process may be used to form electrically insulated conductor 40 using uniform thickness thin sheet of aluminum 20 envelope solid copper/copper alloy core 26. Similar processes may be used to form insulated electric conductors 42 and 44.

Figure 2:
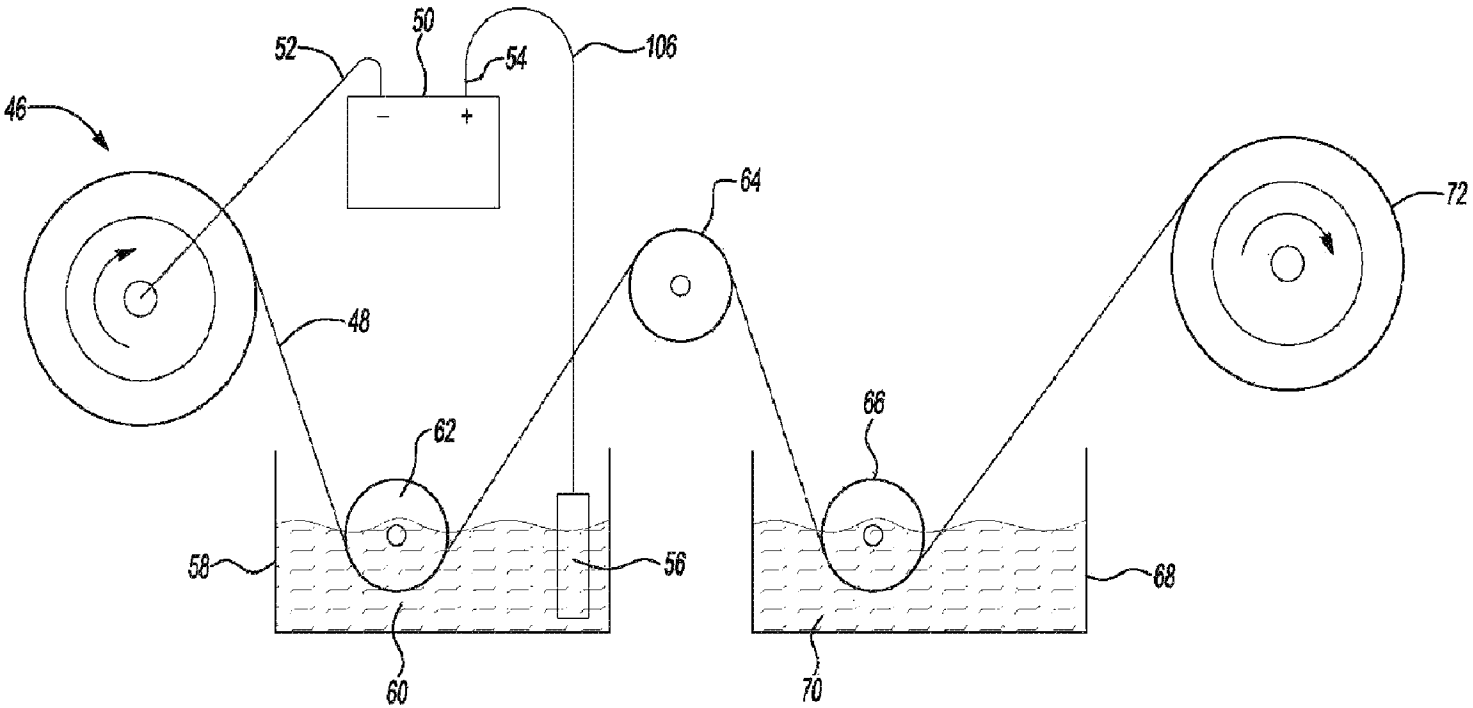
FIG. 2 is a graphical representation of a continuous electrolytic process for forming a dielectric layer on a composite copper/aluminum conductor and on aluminum enveloped assemblies of insulated electric conductors.

Referring now to FIG. 2, a graphical representation of a continuous electrolytic process for forming a dielectric layer 34 on insulated electric conductors 32 is illustrated. Supply or feed roll 46 contains a continuous length of wire 48 having a copper or copper alloy core enveloped by a uniform thickness sheet of aluminum 22 as previously described. A power supply 50 has a negative terminal 52 connected to roll 46 and/or wire 48 and a positive terminal 54 connected to an electrode 56, at least a portion of which is disposed within a bath 58 containing an electrolytic agent or solution 60. In one embodiment, a titanium electrode 56 may be used with a solution 60 of dilute sulfuric acid with 6 parts water to 1 part $H_2SO_4$. In other embodiments, electrode 56 may be made of lead or platinum. In still other embodiments, electrode 56 may be made of any other suitable material. A guide roller 62 is at least partially submerged in solution 60 and guides a predetermined length of wire 48 through a solution 60 with a voltage applied across terminals 52, 54 to generate a suitable electric current through solution 60 from electrode 56 to wire 48. The electric current facilitates the chemical reaction of solution 60 with an outer surface of the aluminum developing wire 48 to form a dielectric layer of aluminum oxide that is substantially free of holes or voids.

Additional guide pulleys 64 and 66 may be used to direct wire 48 through an optional rinse 68 having a suitable solution or rinse agent 70 such as deionized water, for example, before being collected by take-up spool 72, which may be driven by an appropriate motor (not shown). Rinse 68 may be used to remove any residual electrolytic agent 60 from wire 48 to facilitate the handling and to further retard or halt the oxidation process. The simplified process illustrated in FIG. 2 may be supplemented with various types of equipment/controls to more precisely control the anodization process and the characteristics in thickness of the resulting dielectric layer.

As discussed below, the embodiments of the invention described below entail gathering pluralities of the insulated electrical conductors 32 made using the above method, and bundling or assembling them in the various configurations described below, enveloping the various configurations in an additional layer or layers of uniform thickness thin sheets of aluminum 20 and repeating the simplified process illustrated in FIG. 2.

Figure 3:
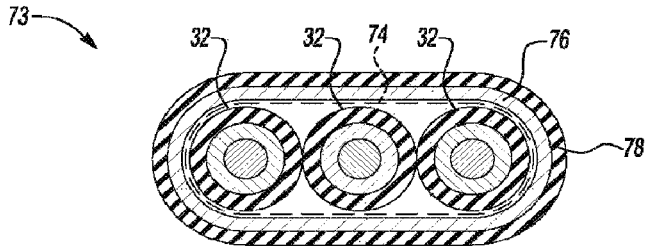
FIG. 3 is a schematic view illustrating the cross section of a first embodiment of an insulated assembly of insulated electric conductors.

With respect to FIG. 3, a first embodiment of an insulated assembly of insulated conductors 73 including three insulated electric conductors 32 is schematically illustrated in cross section. Electric conductors 32 are disposed proximate one another in a line abreast configuration to form a first plurality 74 of insulated conductors. In other implementations, the insulated electric conductors 32 may be positioned in a triangular orientation. In other implementations, only two insulated electric conductors 32 may be employed while in still other implementations, greater than three insulated electric conductors 32 may be employed and disposed in various different geometric configurations. Additionally, it should be understood that although cores 22 having a circular cross section have been depicted, individual cores 22 having any desirable cross section geometry may be utilized.

The first plurality of insulated conductors 74 is surrounded by a first aluminum layer 76 which has been mechanically formed to the first plurality of insulated conductor 74 in any one of the manners described above. A first single dielectric layer of aluminum oxide 78 surrounds first aluminum layer 76 to form an electrically insulating layer that is substantially impervious to environmental conditions such as salt spray, resilient to mechanical abrasions and thermally conductive to permit the dissipation of heat.

First aluminum layer 76 and first single dielectric layer of aluminum oxide 78 are formed by mechanically forming uniform thickness thin sheet of aluminum 20 about first plurality of insulated conductor 74 and then subjecting the assembly of the first plurality of insulated conductors 74 and the uniform thickness thin sheet of aluminum 20 to the process described above which is graphically depicted in FIG. 2.

Figure 4:
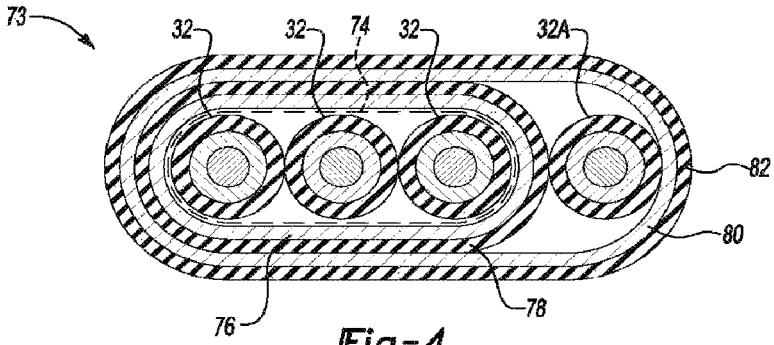
FIG. 4 is a schematic view illustrating a cross section of an alternate implementation of the insulated assembly of FIG. 3.

With respect to FIG. 4, an alternate implementation of insulated assembly 73 is depicted. In this implementation, an additional insulated electric conductor 32A is positioned in close proximity to first single dielectric layer of aluminum oxide 78. A second layer of aluminum 80 surrounds the additional insulated electric conductor 32A and the first single dielectric layer 78. A second single dielectric layer of aluminum oxide surrounds second layer of aluminum 80. Second layer of aluminum 80 and second single dielectric layer 82 are formed about the additional insulated electric conductor 32A and the first single dielectric layer 78 in the manner described above, i.e. by mechanically forming a uniform thickness thin sheet of aluminum 20 about additional insulated electric conductor 32A and first single dielectric layer of aluminum oxide 78 and then subjecting that assembly to the electrolytic process described above and depicted in FIG. 2. The configuration depicted in FIG. 4 may be advantageous in circumstances where the signal strength or the current carried in additional insulated electric conductor 32A is substantially greater than or less than corresponding current/signals carried in the insulated electric conductors 32 of the first plurality 74 and additional shielding between the insulated electrical conductors is desirable.

Figure 5:
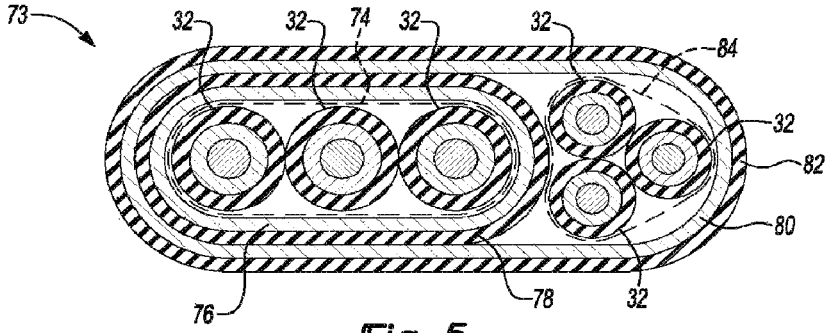
FIG. 5 is a schematic view illustrating a cross section of another alternate implementation of the insulated assembly of FIG. 3.

With respect to FIG. 5, an additional implementation of insulated assembly 73 is depicted. In this implementation, a second plurality 84 of insulated electric conductors 32 is positioned in close proximity to the first single dielectric layer of aluminum oxide 78. In the illustrated embodiment, only three additional insulated electric conductors 32 are illustrated. It should be understood, however, that any number of additional insulated electric conductors 32 may be employed. Additionally, the insulated electric conductors 32 of the second plurality 84 may be positioned in any desirable configuration and may be spaced apart from one another.

Figure 6:
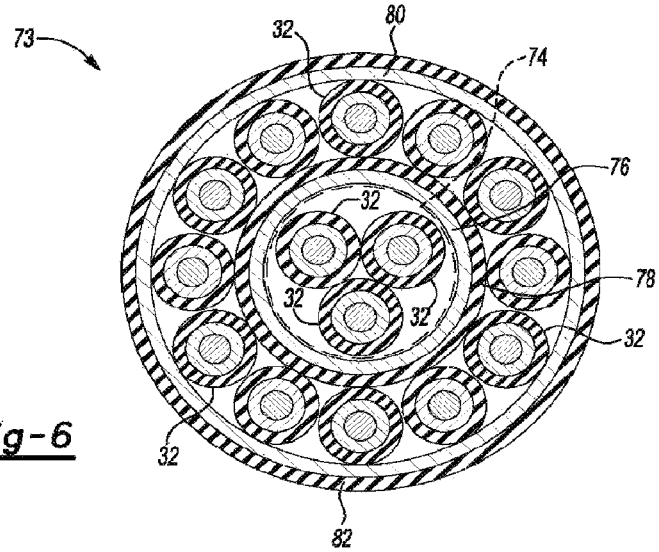
FIG. 6 is a schematic view illustrating a cross section of another alternate implementation of the insulated assembly of FIG. 3.

With respect to FIG. 6, a variation of the insulated assembly 73 illustrated in FIG. 5 is depicted. In this implementation, the insulated electric conductors 32 of the first plurality 74 have been clustered together in a triangular arrangement and the insulated electric conductors 32 of the second plurality 84 have been arranged coaxially around the first single dielectric layer 78. The configuration depicted in FIG. 6 may be useful for densely packing large numbers of individual insulated electric conductors 32 within small or confined spaces or to permit a relatively large number of individual insulated electric conductors 32 within a space having a standard dimension.

Figure 7:
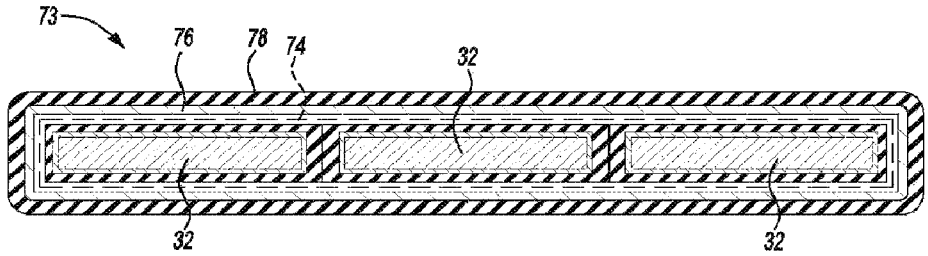
FIG. 7 is a schematic view illustrating a cross section of another alternate implementation of the insulated assembly of FIG. 3.

With respect to FIG. 7, an implementation of insulated assembly 73 is illustrated employing insulated electric conductors 32 having rectilinear cross sections such as copper cores typically used in ribbon-wire type electrical connectors. The individual insulated electric conductors 32 have been positioned line abreast. One of ordinary skill in the art will appreciate that other configurations such as stacking one insulated electric conductor on top of another or having multiple layers of offset insulated electric conductors (similar to the configuration of a brick wall) may be arranged as well as any other desirable configuration. The advantages of such configuration include the ability to conform to spacial limitations of an intended application and the exposure of larger surface areas for a given volume of copper/copper alloy core to permit quicker and more efficient dissipation of heat.

Figure 8:
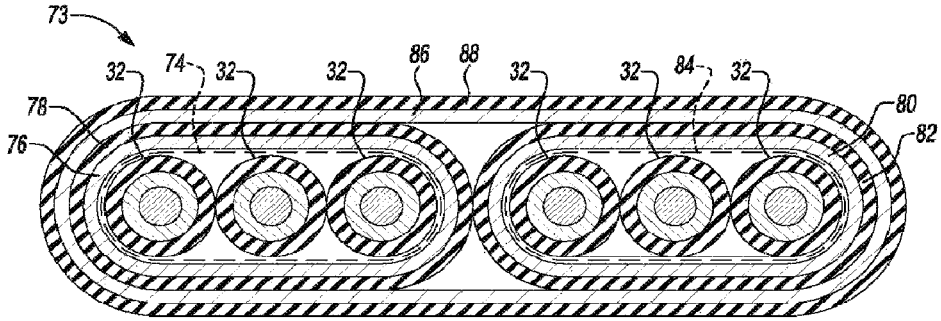
FIG. 8 is a schematic view illustrating a cross section of another alternate implementation of the insulated assembly of FIG. 3.

With respect to FIG. 8, another implementation of insulated assembly 73 is depicted. In this implementation, second aluminum layer 80 is mechanically formed about second plurality of insulated conductors 84 and second single dielectric layer 82 surrounds second layer of aluminum 80. A third aluminum layer 86 is mechanically formed to envelope first single dielectric layer of aluminum oxide 78 and second single dielectric layer of aluminum oxide 82. A third single dielectric layer of aluminum oxide 88 surrounds third aluminum layer 86. Third aluminum layer 86 and third single dielectric layer of aluminum oxide 88 are formed by enveloping first single dielectric layer 78 and second single dielectric layer 82 with uniform thickness thin sheet of aluminum 20 and then subjecting that assembly to the electrolytic process described above with respect to FIG. 2. In this manner, any desirable number of insulated assemblies 73 may be configured and enveloped in layers of aluminum and aluminum oxide. This may be desirable to provide additional layers of insulation between individual insulated electric conductors 32 carrying higher or lower voltages, currents, and higher or lower strength signals.

Figure 9:
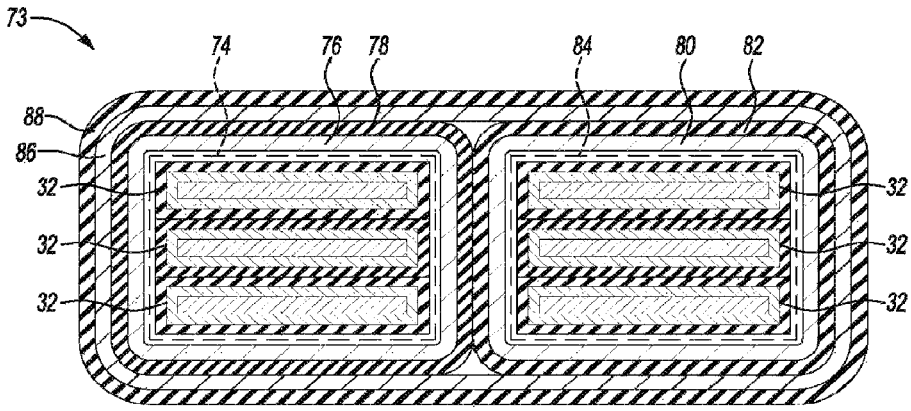
FIG. 9 is a schematic view illustrating a cross section of another alternate implementation of the insulated assembly of FIG. 3.
Figure 10:
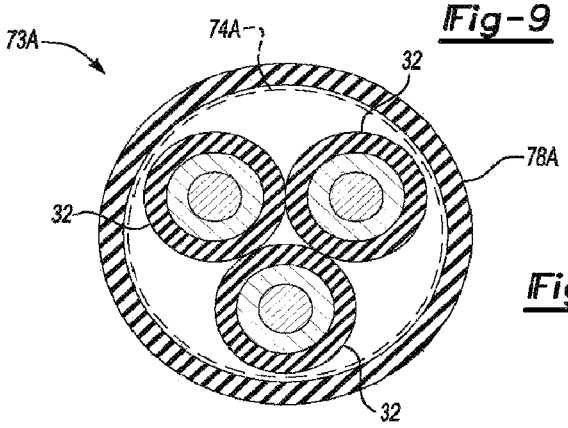
FIG. 10 is a schematic view illustrating the cross section of a second embodiment of an insulated assembly of insulated electric conductors.
Figure 11:
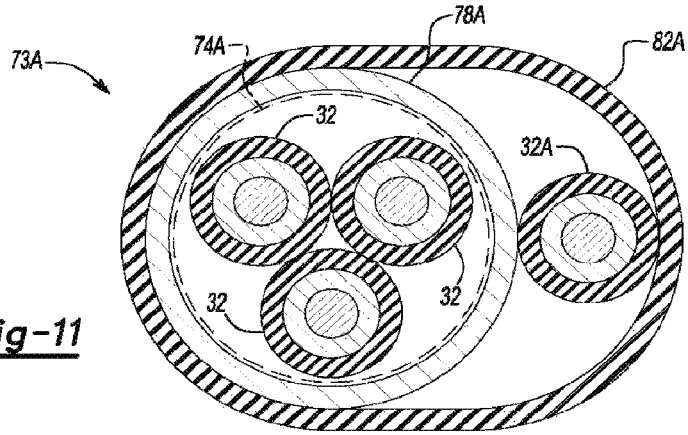
FIG. 11 is a schematic view illustrating a cross section of an alternate implementation of the insulated assembly of FIG. 10.
Figure 12:
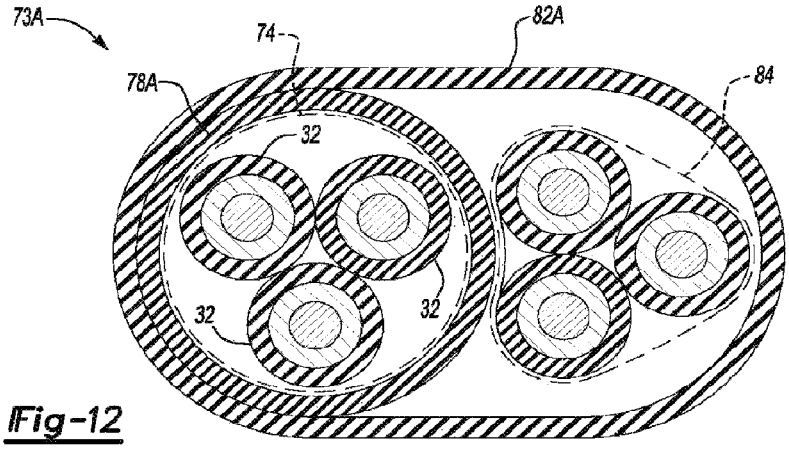
FIG. 12 is a schematic view illustrating a cross section of another alternate implementation of the insulated assembly of FIG. 10.
Figure 13:
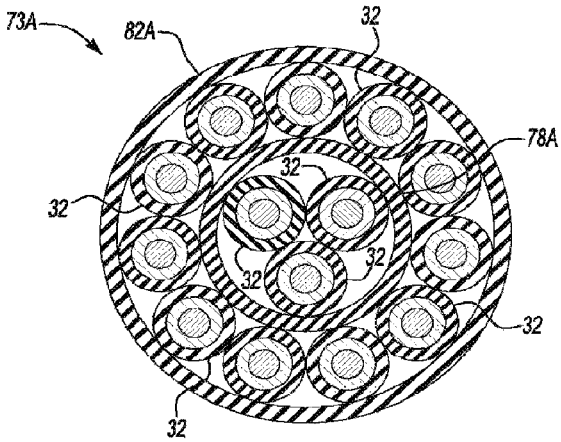
FIG. 13 is a schematic view illustrating a cross section of another alternate implementation of the insulated assembly of FIG. 10.
Figure 14:
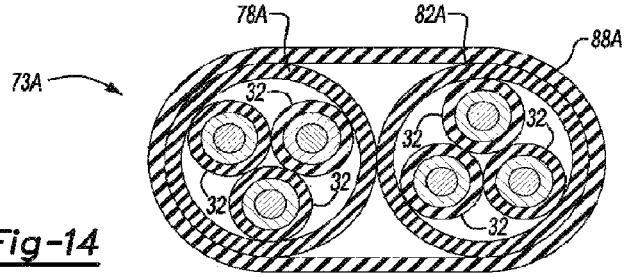
FIG. 14 is a schematic view illustrating a cross section of another alternate implementation of the insulated assembly of FIG. 10.
Figure 15:
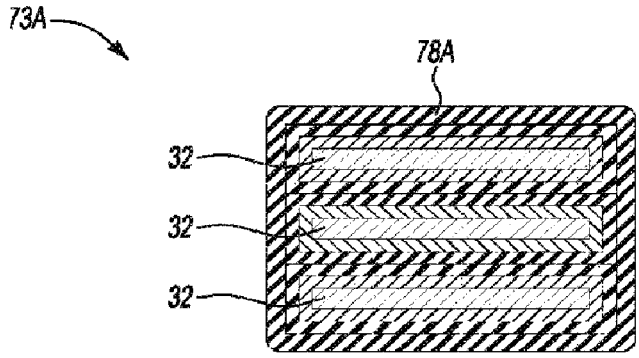
FIG. 15 is a schematic view illustrating a cross section of another alternate implementation of the insulated assembly of FIG. 10.

With respect to FIG. 9, a variation of the insulated assembly 73 of FIG. 8 is depicted. In FIG. 9, the insulated electric conductors 32 are rectilinear and are stacked one on top of the other. First plurality 74 is surrounded by first aluminum layer 76 which, in turn, is surrounded by first single dielectric layer of aluminum oxide 78. Second plurality of insulated electric conductors 84 is surrounded by second layer of aluminum 80 which, in turn, is surrounded by second single dielectric layer 82. The individual insulated electric conductors 32 of the second plurality 84 are also stacked one on top of the other. First single dielectric layer 78 and second single dielectric layer 82 are positioned adjacent one another so that the first plurality of electric conductors 74 and the second plurality of electric conductors 84 are positioned generally side by side. First single dielectric layer 78 and second single dielectric layer 82 are surrounded by third aluminum layer 86 which, in turn, is surrounded by third single dielectric layer out of aluminum oxide 88. This configuration allows for the dense packing of multiple rectilinear shaped insulated electric conductors to permit a more efficient use of confined space or to permit a higher volume electric conductor to pass through an area having predetermined spacial dimensions.

With respect to FIGS. 10 through 15, a second embodiment of the present invention is illustrated. With respect to FIG. 10, insulated assembly of insulated conductors 73A includes a first plurality 74A of insulated conductors 32 surrounded by a first single dielectric layer of aluminum oxide 78A. In this embodiment, the first plurality of insulated conductors 74A was first surrounded by a uniform thickness thin sheet of aluminum 20 and then subjected to the electrolytic process described above with respect to FIG. 2 for a prolonged period of time until all of the aluminum in uniform thickness thin sheet of aluminum 20 was oxidized to form first single dielectric layer of aluminum oxide 78A. Alternatively, other methods of completely oxidizing the uniform thickness thin sheet of aluminum 20 may be employed.

With respect to the implementations depicted in FIGS. 11-15, these implementations depict configurations similar to those described above. For instance, the configuration depicted in FIG. 11 corresponds with the configuration depicted in FIG. 4. The configuration depicted in FIG. 12 corresponds with the configuration depicted in FIG. 5. The configuration depicted in FIG. 13 corresponds with the configuration depicted in FIG. 6. The configuration depicted in FIG. 14 corresponds with the configuration depicted in FIG. 8. The configuration depicted in FIG. 15 corresponds with the configuration depicted in FIG. 7. In these figures, reference numbers 82A and 88A refer to substantially completely oxidized dielectric layers of aluminum oxide.

Figure 16:
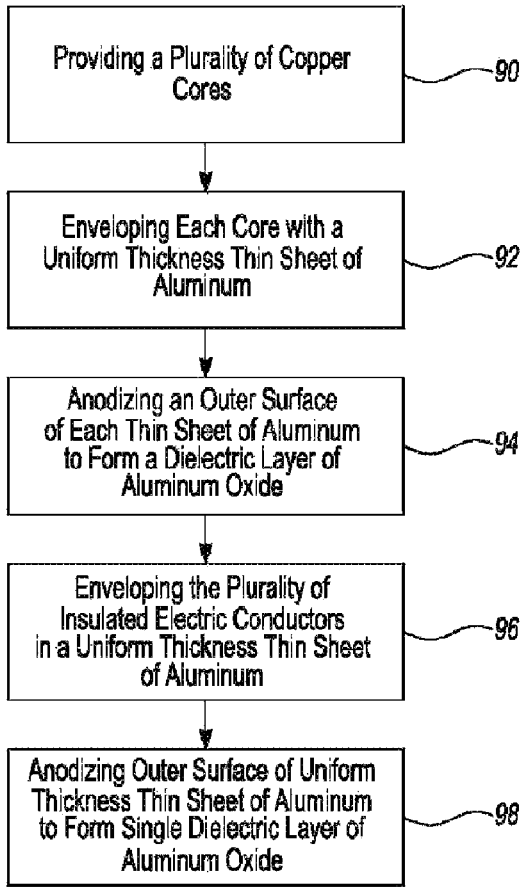
FIG. 16 is a block diagram illustrating the steps embodying a process implementing a third embodiment of the disclosed invention.

With respect to FIG. 16, a flowchart illustrating a method for making insulated assembly 73 according to embodiments of the present disclosure is illustrated. As those of ordinary skill in the art will appreciate, the process steps represented in FIG. 16 provide a summary or overview of a process for making an electrically insulated assembly of insulated electric conductors according to the teachings of the present disclosure. Various steps in the process may be omitted and/or performed in a sequence different from that illustrated in the Figures while still providing a product or process consistent with the teachings of this disclosure and contemplated by the present inventors.

At block 90, a plurality of copper/copper alloy cores 22 are provided. At block 92, each individual core is enveloped within a uniform thickness thin sheet of aluminum 20. At block 94, an outer surface of each thin sheet of aluminum 20 is anodized to form a dielectric layer of aluminum oxide surrounding each individual core. At block 96, the plurality of insulated electric conductors produced during the step corresponding to block 94 is enveloped in a uniform thickness thin sheet of aluminum. At block 98, an outer surface of the uniform thickness thin sheet of aluminum 20 is anodized to form a single dielectric layer of aluminum oxide surrounding the plurality of insulated electric conductors 20. Additional insulated electric conductors can be produced using the above process and assembled together in various configurations and enveloped in uniform thickness thin sheets of aluminum which are then anodized to form various configurations of insulated assemblies 73 disclosed in FIGS. 3-15 above as well as other configurations not illustrated.

While the best mode for carrying out the invention has been described in detail, those familiar with the art to which this invention relates will recognize various alternative designs and embodiments for practicing the invention as defined by the following claims.

What is claimed:

1. An insulated assembly of electric conductors comprising:

first and second electric conductors, each having a copper core, an aluminum layer disposed around the copper core, and a dielectric layer of aluminum oxide disposed on an outer surface of the aluminum layer;

a first aluminum layer disposed around the first electric conductor;

a first dielectric layer of aluminum oxide disposed on the first aluminum layer;

a second aluminum layer disposed around the second electrical conductor and the first dielectric layer; and a second dielectric layer of aluminum oxide disposed on the second aluminum layer.

2. The insulated assembly of claim 1 wherein the aluminum layer of the first and second electrical conductors has a substantially uniform thickness.

3. The insulated assembly of claim 1 wherein the second electric conductor engages the first dielectric layer and the second aluminum layer.

4. The insulated assembly of claim 1 wherein the second aluminum layer and the second dielectric layer are coaxial with the first dielectric layer.

5. The insulated assembly of claim 1 wherein at least one copper core comprises a generally circular cross section.

6. The insulated assembly of claim 1 wherein a plurality of second electric conductors are disposed around the first dielectric layer.

7. The insulated assembly of claim 1 wherein at least one copper core comprises a generally rectilinear cross section.

8. The insulated assembly of claim 1 wherein a plurality of first electric conductors are disposed within the first aluminum layer.

9. The insulated assembly of claim 1 further comprising:

a third aluminum layer disposed around the second electric conductor; and a third dielectric layer of aluminum oxide disposed on the third aluminum layer;

wherein the third aluminum layer is disposed outside the first aluminum layer and inside the second aluminum layer.

10. The insulated assembly of claim 9 wherein the third dielectric layer engages the second aluminum layer.

11. The insulated assembly of claim 9 wherein the third aluminum layer engages the second electric conductor.

12. The insulated assembly of claim 1 further comprising a plurality of first electric conductors stacked on each other.

13. The insulated assembly of claim 12 further comprising a plurality of second electric conductors stacked on each other and disposed adjacent to the plurality of first electric conductors.

14. An insulated assembly of electric conductors comprising:

first and second electric conductors, each having a copper core, an aluminum layer disposed around the copper core and a dielectric layer of aluminum oxide disposed on an outer surface of the aluminum layer;

first dielectric layer of aluminum oxide disposed around the first electric conductor; and a second dielectric layer of aluminum oxide disposed on the first dielectric layer.

15. The insulated assembly of claim 14 wherein the aluminum layers of the first and second electric conductors are substantially completely anodized into aluminum oxide.

16. The insulated assembly of claim 14 wherein the second electric conductor engages the first and second dielectric layers.

17. The insulated assembly of claim 14 wherein the second dielectric layer is coaxial with the first dielectric layer.

18. The insulated assembly of claim 14 further comprising:

a third dielectric layer of aluminum oxide that envelops the second electric conductor and is disposed outside the first dielectric layer and inside the second dielectric layer.

19. The insulated assembly of claim 14 wherein each copper core comprises a generally rectilinear cross section.

20. A method of making an electrical conductor assembly, comprising:

providing first and second conductors having a core and an aluminum layer disposed around the core;

providing a first aluminum layer around the first conductor;

providing a second aluminum layer around the second conductor and the first aluminum layer;

wherein the first and second aluminum layers are at least partially anodized to form dielectric layers of aluminum oxide.

* * * * *